United States Patent [19]

Rose

[11] 4,448,422

[45] May 15, 1984

[54] BOARD GAME APPARATUS

[76] Inventor: Donald G. Rose, Friends Hospital, Philadelphia, Pa. 19124

[21] Appl. No.: 351,240

[22] Filed: Feb. 22, 1982

[51] Int. Cl.[3] ..... A63F 3/00

[52] U.S. Cl. ..... 273/271

[58] Field of Search ..... 273/272, 236, 242, 258, 273/264, 271

[56] References Cited

U.S. PATENT DOCUMENTS 1,633,887 5/1928 Espitallier ..... 273/258

2,772,885 12/1956 Wales ..... 273/258

FOREIGN PATENT DOCUMENTS 4215 of 1884 United Kingdom ..... 273/271

*Primary Examiner*—Richard C. Pinkham

*Assistant Examiner*—Matthew L. Schneider

*Attorney, Agent, or Firm*—Benasutti and Murray

[57] ABSTRACT

A game board apparatus including a plurality of markers, a deck of cards and a game board. The game board includes linear indicia which combine to form a plurality of intersecting groups, and three groups or series of numerical indicia; a first associated with selected points of intersection of linear indicia; a second associated with one end of each intersecting group; and a third associated with the other end of each intersecting group.

22 Claims, 1 Drawing Figure

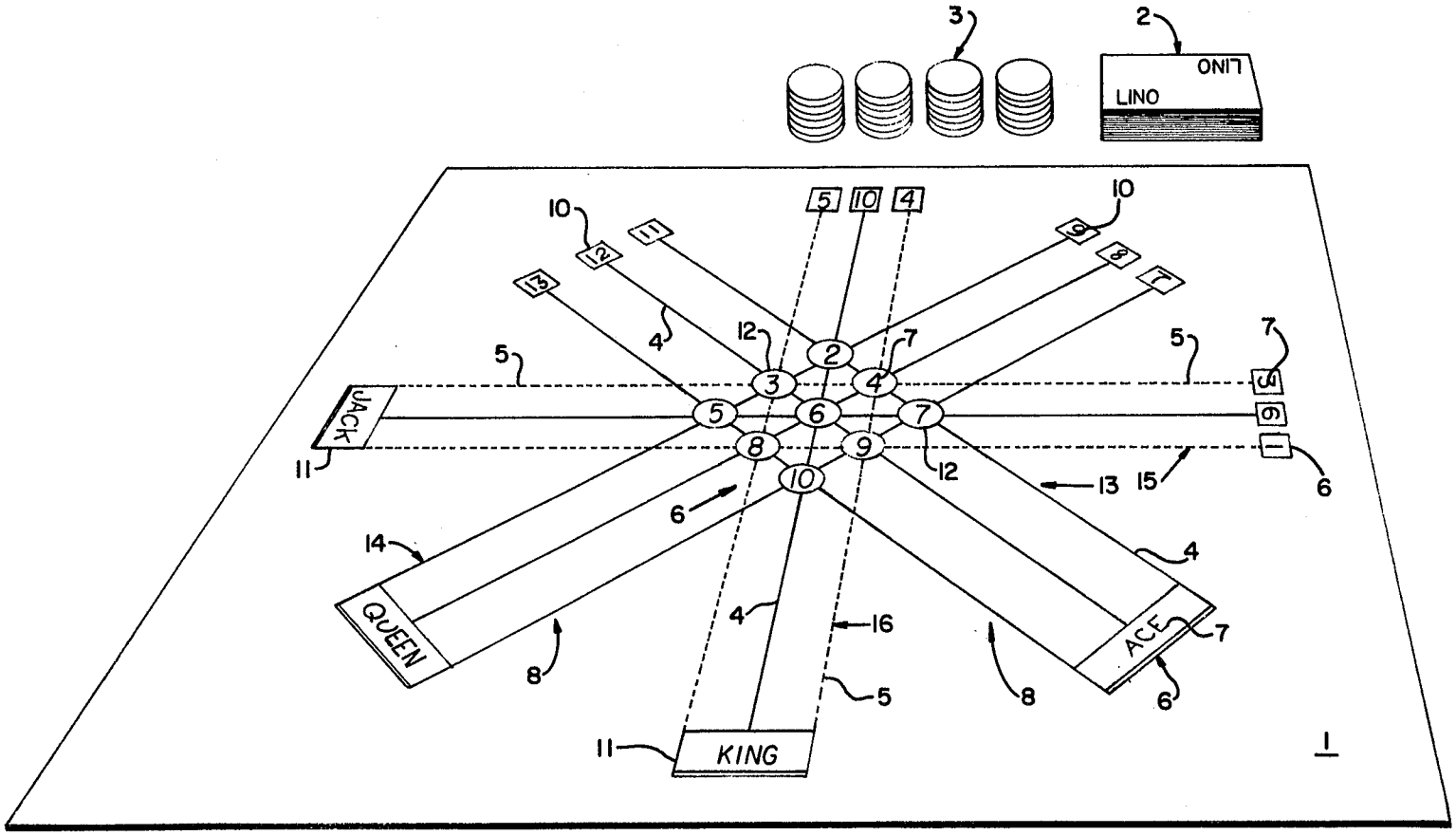
LINO
LINO
ACE
KING
QUEEN
JACK

BOARD GAME APPARATUS

BACKGROUND OF THE INVENTION

The present invention relates generally to the field of board games, and more particularly, to a board game apparatus which is both entertaining and useful in developing mathematical skills.

A variety of games and devices have been developed which attempt to sharpen mathematical skills in an entertaining, and therefore enjoyable manner. However, many of these games are rather complex, and accordingly, cannot be played by persons of all ages and/or levels of skill. Alternatively, many of these games are too simple to maintain the interest of persons playing the game. It therefore remains desirable to develop a board game apparatus which can be used to sharpen mathematical skills and which is sufficiently challenging to maintain player interest, yet sufficiently versitile to permit play of the game by persons of different ages and/or levels of skill.

SUMMARY OF THE INVENTION

In accordance with the present invention, a board game apparatus is provided which generally comprises a game board; a deck of cards; means for marking areas of the game board in accordance with the card or cards selected; and rules of play for the game.

The game board generally includes a plurality of linear indicia and a plurality of numerical indicia which combine to form a series of intersecting paths. In the preferred embodiment, the linear indicia combine to form four groups of paths, each group terminating at a series of frames containing numerical indicia. Selected intersections of linear indicia are provided with additional frames, also containing numerical indicia.

The numerical indicia associated with the frames of the game board are preferably representative of the numbers 1–13, distributed in a selected manner, as well as the jack, queen, king and ace which traditionally form part of a conventional deck of playing cards.

The deck of cards which is used in conjunction with the game board preferably includes cards of the type which are traditionally used in conjunction with play of the game of "bridge".

In play, linear indicia are "captured" in accordance with numerical values developed using cards drawn from the deck. The markers are used to indicate which of the linear indicia have been captured. The player accumulating the highest number of points in capturing the linear indicia is deemed the winner of the game. Since specified combinations of cards are necessary to capture each of the linear indicia, a player's mathematical skills are enhanced in an entertaining fashion.

Accordingly, it is a primary object of the present invention to provide a board game apparatus which is useful in developing mathematical skills.

It is also an object of the present invention to provide a board game apparatus which is capable of improving mathematical skills in an entertaining manner.

It is also an object of the present invention to provide a board game apparatus which may be used in conjunction with rules of play which are sufficiently challenging to maintain a player's interest, and which are sufficiently versitile to appeal to a wide variety of players.

These and other objects will become apparent from the following detailed description, taken in conjunction with the following illustration.

BRIEF DESCRIPTION OF THE DRAWING

FIG. 1 is a perspective view illustrating a board game apparatus produced in accordance with the present invention, and the implements which are used in conjunction with play of the game.

DESCRIPTION OF THE PREFERRED EMBODIMENT

Although specific forms of the invention have been selected for illustration and the following description is drawn in specific terms for the purpose of describing these forms of the invention, this description is not intended to limit the scope of the invention which is defined in the appended claims.

FIG. 1 illustrates preferred embodiment implements which may be used to play the game of the present invention. These implements generally include a board 1, a deck of cards 2, and a plurality of markers 3.

The board 1 generally comprises a plurality of linear indicia 4, 5, and a plurality of associated frames 6 which are provided with numerical indicia 7 in a manner which will be more fully described below.

The linear indicia 4, 5 are separated into four groups 8, each comprising three linear indicia 4, 5 positioned in substantially parallel, spaced relation to one another. The groups 8 are then radially oriented with respect to each other so that they intersect at or near the center of the game board 1, to form the grid 9 illustrated.

The ends of the linear indicia 4, 5 are provided with a plurality of frames containing the numerical indicia 7 forming part of the game. For example, one end of each of the linear indicia 4, 5 is provided with a substantially square frame 10. The frames 10 are provided with numerical indicia selected from the numerical range of 1 to 13, and are used to identify the linear indicia 4, 5 with which they are associated. The opposing ends of the linear indicia 4, 5 forming a group 8 are provided with a rectangular frame 11 extending fully between the ends of the associated linear indicia 4, 5. The frames 11 are preferably positioned adjacent one another, and are provided with the indicia "JACK," QUEEN," "KING," and "ACE," respectively, which are representative of the jack, queen, king and ace of a deck of playing cards.

As previously described, the groups 8 preferably intersect at or near the center of the board 1. Selected points of intersection, as shown, are provided with substantially circular frames 12 which preferably combine to form the patterned network 9 shown. In the preferred embodiment, these selected points of intersection occur at positions where at least three linear indicia 4, 5 intersect. Each of the frames 12 are then provided with numerical indicia selected from the numerical range of 2 to 10.

As illustrated, the linear indicia 4, 5 are formed as either solid lines 4 or dotted lines 5. In the embodiment selected for illustration in FIG. 1, two of the groups 8, designated by the reference numerals 13, 14, include only solid lines 4 while two of the groups 8, designed by the reference numerals 15, 16 include two, peripherally disposed dotted lines 5 and a centrally disposed solid line 4.

The deck of cards 2 preferably corresponds to a conventional deck of cards of the type which is traditionally used in play of the game of "bridge." As a result, the cards associated with the deck 2 may be corelated with the numerical indicia 7 (both numbers and figures) which are provided on the game board 1. The markers 3 are used to indicate moves made on the game board 1 by the players of the game, in response to cards drawn from the deck 2 in accordance with the following rules.

Referring again to FIG. 1, it may be seen that the game board 1 is provided with twenty-one numbered frames 10, 12, and four frames 11 representative of the jack, queen, king and ace associated with the deck of cards 2. The linear indicia 4, 5 define twelve lines; eight solid lines 4 which intersect with three frames 12, and four dotted lines 5 which intersect with two frames 12, as shown. A frame 10 is associated with one end of each line 4, 5 and is assigned a value in accordance with the number contained within the frame 10. The remaining ends of the lines 4, 5 forming a group 8 are provided with one of the frames 11. In this manner, the score or point value of a line 4, 5 is indicated by its associated frame 10, while the frames 11, 12 are indicative of the cards which must be played to win the game in accordance with its rules.

In play, the game preferably proceeds as follows, and can be played by two or more players as desired. First, the deck of cards 2 is shuffled and the cards are played on the board 1 facing downwardly. Next, a first player selects four cards from the top of the deck 2, which cards are then capable of being played. Playing a card is accomplished by corelating the markings on the card (including jacks, queens, kings and aces) with the frames 11, 12 on the board 1, and by placing a marker 3 indicative of the player (color, pattern, shape, etc.) on a selected line 4, 5 associated with the corresponding frame 11, 12. After being played, cards are preferably then placed, facing upwardly, next to the deck 2 for convenience. If two selected cards can be played on a given line, two markers 3 would then be positioned on that line, and so on. In the event that duplicate cards are selected, only one card may be played on a particular line 4, 5. However, such duplicate cards may be played on other lines 4, 5, if possible.

After the cards selected by the first player have been played, any other players would then, in turn, select four cards from the top of the deck 2. These cards would then be corelated with the frames 11, 12, and played in similar fashion.

The object of the game is to "capture" as many lines 4, 5 as is possible. Capture of a line 4, 5 is accomplished by corelating a specified number of frames 11, 12 associated with a particular line with cards selected from the deck 2. Preferably, five appropriately played cards are required to capture a solid line 4, while four appropriately played cards are required to capture a dotted line 5. Capture of a line 4, 5 is indicated by placing a marker 3 adjacent the frame 10 associated with the line captured. The number provided in the frame 10 of the captured line indicates the point value for the line captured. Once captured, the line 4, 5 is no longer available for play.

Play proceeds until all of the lines 4, 5 have been captured in the foregoing manner. If, after all of the cards of the deck 2 have been used, lines 4, 5 remain to be captured, the deck of cards 2 is re-schuffled and again placed, facing downwardly, on the table so that play may continue as previously described. Clearly, as the game progresses, cards having certain numerical value will no longer be playable since no correlating number will remain available on the board 1. Such cards, when selected, are therefore simply discarded.

After all twelve lines 4, 5 have been captured, the score or point value representative of each line 4, 5 captured by a particular player is then tallied, and the player having the highest score wins the game.

It will therefore be seen that the foregoing board game apparatus serves well to satisfy each of the objectives previously set forth. However, it should also be understood that the board game apparatus of the present invention is capable of variation.

For example, the number of lines available for play, as well as their orientation and respective point value, are capable of variation. The indicia associated with each of the frames 10, 11, 12 may also be varied, creating different combinations for play. Further, other types of cards may be used in play of the game including both conventionally available decks of cards, as well as non-conventional decks having specified combinations of cards, provided the markings on the cards are suitably corelated to the markings on the game board. Lastly, the means used to indicate a player's moves may also be varied. For example, in the foregoing discussion, use of a plurality of tokens 3 is described. However, other markers may also be used. In fact, it is even possible for a player's name or initials to be applied directly to the board in substition for the markers 3, if desired. In such a case, the board 1 may even be formed of a disposable material, so that each board 1 may be disposed of after a game has been played. Other variations are also clearly possible.

It will therefore be understood that various changes in the details, materials and arrangement of parts which have been herein described and illustrated in order to explain the nature of this invention may be made by those skilled in the art within the principle and scope of the invention as expressed in the following claims.

What is claimed is:

1. A game board adapted for use in conjunction with a board game apparatus, said game board comprising:
   (a) a plurality of linear indicia; and
   (b) a plurality of numerical indicia;
   (c) wherein said linear indicia combine to form a plurality of groups;
   (d) wherein said groups of linear indicia intersect one another in an essentially centrally disposed region of said game board;
   (e) wherein a first series of numerical indicia are operatively associated with selected intersections of linear indicia; and
   (f) wherein a second series of numerical indicia are operatively associated with an end of each group of linear indicia, a single one of said second series of numerical indicia intersecting with the end of each of the linear indicia forming said associated group, and said single one of said second series of numerical indicia being common to all said linear indicia within said group.

2. The game board of claim 1 wherein said linear indicia comprising said groups are spaced from and parallel to one another.

3. The game board of claim 1 wherein said first series of numerical indicia are located at intersections of at least three linear indicia.

4. The game board of claim 1 wherein said first series of numerical indicia form a regular, substantially square pattern in said centrally disposed region of said game board.

5. The game board of claim 1 wherein linear indicia intersecting two of said first series of numerical indicia are discontinuous.

6. The game board of claim 1 wherein linear indicia intersecting three of said first series of numerical indicia are continuous.

7. The game board of claim 1 wherein said second series of numerical indicia are positioned adjacent one another.

8. The game board of claim 1 wherein a third series of numerical indicia are operatively associated with another end of the linear indicia opposing the end associated with said second series of numerical indicia.

9. The game board of claim 8 wherein said third series of numerical indicia are substantially square.

10. The game board of claim 8 wherein a separate one of said third series of numerical indicia is associated with each of said linear indicia comprising said groups.

11. The game board of claim 1 wherein each of said groups includes three linear indicia.

12. The game board of claim 1 having four intersecting groups of linear indicia.

13. The game board of claim 1 wherein said first series of numerical indicia are substantially circular.

14. The game board of claim 1 wherein said second series of numerical indicia are substantially rectangular.

15. The game board of claim 1 wherein said groups of linear indicia are substantially radially, symmetrically disposed about the centrally disposed region of said game board.

16. The game board of claim 1 wherein said groups of linear indicia only intersect one another in said essentially centrally disposed region of said game board.

17. A board game apparatus comprising:

(a) a game board as claimed in claim 1;

(b) marker means for identifying selected ones of said linear indicia and said numerical indicia; and (c) a plurality of cards including means for correlating said marker means with said identified linear indicia and numerical indicia.

18. The board game apparatus of claim 17 wherein said marker means comprise a plurality of tokens.

19. The board game apparatus of claim 17 wherein said cards comprise indicia which correspond to a conventional bridge deck.

20. A game board adapted for use in conjunction with a board game apparatus, said game board comprising:

(a) a plurality of linear indicia, combined to form a plurality of separate groups;

(b) a substantially centrally disposed region wherein said groups of linear indicia intersect one another to form a radially disposed pattern about said centrally disposed region; and (c) a plurality of numerical indicia;

(d) wherein a first series of numerical indicia are located within said centrally disposed region and are operatively associated with selected intersections of linear indicia; and (e) wherein a second series of numerical indicia are operatively associated with an end of each group of said linear indicia, and a single one of said second series of numerical indicia intersects with the end of each of the linear indicia forming said group, said single one of said second series of numerical indicia being common to all said linear indicia within said group.

21. The game board of claim 20 wherein a third series of numerical indicia are operatively associated with another end of each group of said linear indicia opposing the end associated with said second series of numerical indicia, and a separate one of said third series of numerical indicia intersect with the end of each of the linear indicia forming said group.

22. A game board adapted for use in conjunction with a board game apparatus, said game board comprising:

(a) a plurality of linear indicia, combined to form four groups including three spaced, parallel linear indicia in each group;

(b) a centrally disposed region wherein said groups of linear indicia intersect one another to form an essentially symmetrical, radially disposed pattern about said centrally disposed region; and (c) a plurality of numerical indicia;

(d) wherein a first series of numerical indicia are located within said centrally disposed region and are operatively associated with intersections of at least three linear indicia;

(e) wherein a second series of numerical indicia are operatively associated with an end of each group of said linear indicia, and a single one of said second series of numerical indicia intersects with the end of each of the linear indicia forming said group, said single one of said second series of numerical indicia being common to all said linear indicia within said group; and (f) wherein a third series of numerical indicia are operatively associated with another end of each group of said linear indicia opposing the end associated with said second series of numerical indicia, and a separate one of said third series of numerical indicia intersect with the end of each of the linear indicia forming said group.

* * * * *